2/25/86 OR 4,571,993

United States Patent [19]

St. Onge

[11] Patent Number: 4,571,993

[45] Date of Patent: Feb. 25, 1986

[54] CEMENTING SYSTEM INCLUDING REAL TIME DISPLAY

[75] Inventor: Kenneth J. St. Onge, Marlow, Okla.

[73] Assignee: Halliburton Company, Duncan, Okla.

[21] Appl. No.: 583,926

[22] Filed: Feb. 27, 1984

[51] Int. Cl.[4] ..... E21B 47/06

[52] U.S. Cl. ..... 73/151; 73/155; 166/250; 364/422

[58] Field of Search ..... 364/422; 73/155, 151; 166/250

[56] References Cited

U.S. PATENT DOCUMENTS 4,414,846 11/1983 Dublin, Jr. et al. ..... 73/151
4,430,892 2/1984 Owings ..... 73/151
4,432,064 2/1984 Barker ..... 364/422
4,440,239 4/1984 Evans ..... 73/155

*Primary Examiner*—Howard A. Birmiel
*Attorney, Agent, or Firm*—William J. Beard

[57] ABSTRACT

For use with a cement supply, cement pump and a cement delivery system for cementing a well, an indicator including a real time display system is set forth in the preferred and illustrated embodiment. By means of surface measurements obtained at the manifold connecting to the wellhead, a display of the flow of various fluids pumped down hole is obtained. In addition, the device provides real time plotting of bottom hole pressure, hydraulic horsepower and actual hydrostatic gradients. This and other data are displayed along with a mock-up of the piping system at the wellhead, the tubing string in the well and the annular flow path.

14 Claims, 5 Drawing Figures

CEMENTING SYSTEM INCLUDING REAL TIME DISPLAY

BACKGROUND OF THE DISCLOSURE

When it has been determined that a well should be completed, one of the conventional steps implemented is cementing a completion string in place. The cement job may extend the full length of the well bore, or partially encompass selected portions of the well bore. Moreover, it is highly desirable that the cement be delivered to the requisite locations in very rapid order so that it sets at the depths where the cement is desired, and also sets with the requisite speed to ensure a perfected bond with the formation. In conducting such a procedure, it typically will be necessary to pump at least one or two different fluids through the completion or tubing string or both and out into the annular space around the completion string. Sometimes, packers and bridge plugs will be used to isolate particular zones of the well bore. Whatever the case, typically more than one fluid will be pumped into the piping from the surface and into the well. It is very important to locate each slug of fluid at a desired location in the well.

Ordinarily, one of the fluids that will be pumped into the well is a slurry including cement. However, other fluids may be pumped into the well either before or after the cement has been delivered. In that event, it is particularly helpful to represent at the surface in graphic form the real time location of each slug. For instance, the first slug may comprise 1,500 barrels while the next slug may have a volume of 500 barrels. The two slugs will flow serially, one behind the other, and it is very important to represent their real time location so that the operator personnel at the surface can control the pumping process to ensure a proper and complete cementing job.

The flow of cement inevitably is remote from most transducers. It is relatively easy to install and locate transducers at the surface. It is an entirely different matter to locate transducers down hole, especially at the bottom of the well. The present apparatus is a device able to determine and graphically present down hole variables. These variables are important data to enable surface personnel to control the cementing job. As an example, bottom hole pressure is an important variable. It is difficult to install a bottom hole transducer for a measurement of pressure, presumably to telemeter the pressure back to the surface. This apparatus enables calculation of the bottom hole pressure and displays it on a plotter as a function of time, and will display bottom hole pressure along with other variables.

Preferably, this apparatus utilizes a plotter which provides a continuous plot of important variables. One of the variables is the bottom hole pressure as mentioned above. Another important variable is fluid density. Another variable which is helpfully displayed for the operator is pumping rate. This can be obtained from the surface by means of a flow meter installed between the pump and the well head. Equally, surface pressure is important and can be obtained at the surface.

With the foregoing in view, the apparatus of this disclosure is defined and described as a system for use with cementing equipment for delivery of cement under pressure and includes transducers for measurement of variables describing the cement flowing in the piping connected to the well head for cementing a well. The cement flow is measured including flow rate and surface pressure. Well head pressure can also be obtained. The apparatus utilizes inputs from such surface located transducers. Other set inputs are provided such as depth of well and the like. This data is stored to enable calculation and representation of down hole variables including bottom hole pressure, hydraulic horsepower, and actual hydrostatic gradients. The apparatus includes a display which is configured as a bore hole and pipe to represent thereon different slugs of serially pumped fluids so that the operator has a display suitable for representation of the annular space and the fluid slugs in the well.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
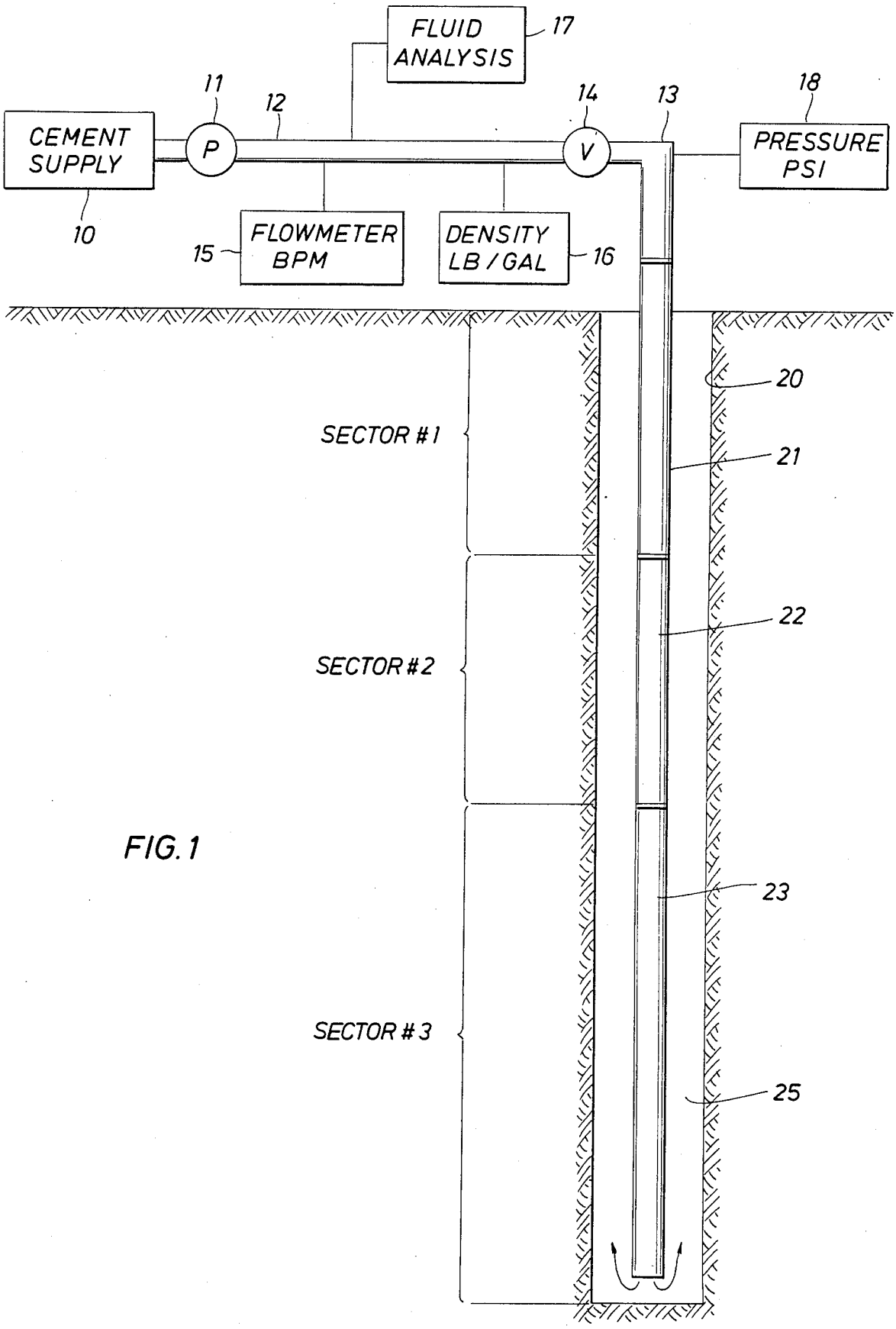
FIG. 1 shows a cementing system connected to a well head with suitable piping and includes various transducers connected to the cement delivery system and well head for measuring dynamics of cement delivery.

Attention is first directed to FIG. 1 of the drawings. There, the equipment for delivery of cement and other fluids into a bore hole are set forth. This will be described first and thereafter the detailed description of the cementing system of this disclosure will be set forth. Briefly, the numeral 10 identifies a cement supply. Typically, cement is mixed in the field and delivered through large pumps 11 into a manifold 12. The manifold is connected to a well head at 13. As appropriate, a suitable valve 14 is interposed between them. The cement is delivered under suitable pressures at selected flow rates. The nature of the cement is variable; indeed, the supply 10 typically includes a slug of cement but it also includes other fluids to be used in the cementing process. Presumably, two or three different fluids are to be pumped into the well to complete the cementing job. The manifold 12 is used to deliver these fluids into the well. The pump 11 is connected with suitable supplies of various fluids for delivery of the various cementing fluids.

At the wellhead, a flow meter 15 measures the rate of flow which is normally expressed in barrels per minute. This is the rate of flow of the fluid delivered into the well. The density of the fluid is also measured at the wellhead by a transducer 16. Density is normally indicated in pounds per gallon. As appropriate, a fluid analysis device 17 is incorporated to make other measurements regarding the fluid. The other measurements are optionally fluid viscosity, gell time and the like for the fluid. The transducers 15, 16 and 17 form output data which is input to the system as will be described. Another important variable is the pressure at the wellhead which is measured by a transducer 18 and which is expressed in pounds per square inch. The pressure transducer 18 is typically calibrated up to several thousand psi. Pressures in this range are not uncommon.

The wellhead 13 is a set of equipment believed to be well known by those of average skill in the art. It is connected to a completion string in the bore hole 20. The bore hole 20 may be cased or open hole, and is represented in a very general form in FIG. 1. While there may be multiple completion strings, FIG. 1 shows a representative single completion string in the well. This is the string of pipe to be cemented in place in the well; this string of pipe normally encloses a separate tubing string to conduct produced oil and gas to the surface. This string can be uniform from top to bottom but it can also be made in different sections. To this end, the upper section is identified by the numeral 21. This section is tubing of a specific diameter and flow characteristic and has a certain length and extends to a selected depth in the bore hole. The number 22 identifies a second section which is serially connected to a third section 23. The sections 21, 22, and 23 jointly comprise the completion string. Moreover, they may be identical and to that degree only a single section need be mentioned. On the other hand, assume that they are different, represented by different lengths and typically formed of different diameters of pipe. As an example, the string can taper wherein the top section is relatively large in diameter and the bottom section 23 is much smaller in diameter. The string terminates at a bottom located opening 24. Again, the precise nature and details of the opening 24 are well known; it can be fitted with various and sundry landing nipples supported by packers, bridge plugs and the like; they have been omitted for sake of clarity in the description of the string and the associated equipment. In general, pipe extends to the bottom or nearly so where cement is delivered from the opening 24. Cement flows into the annular space 25. The cement is delivered into the space 25 to complete the cementing job. This space has been represented in very general form in FIG. 1 and will be understood to be that portion of the well bore where cement is to be delivered, typically defined and isolated by packers or bridge plugs. The annular space 25 may also be temporarily or permanently filled with other fluids either before or after the cement, all for the purpose of completing the cement job and assuring that the cement bond between the string and well bore is completed in the desired fashion. The space 25 is therefore set forth in very general form on the exterior of the string. This fact remains true even should there by multiple tubing strings to multiple zones along the well.

Figure 2:
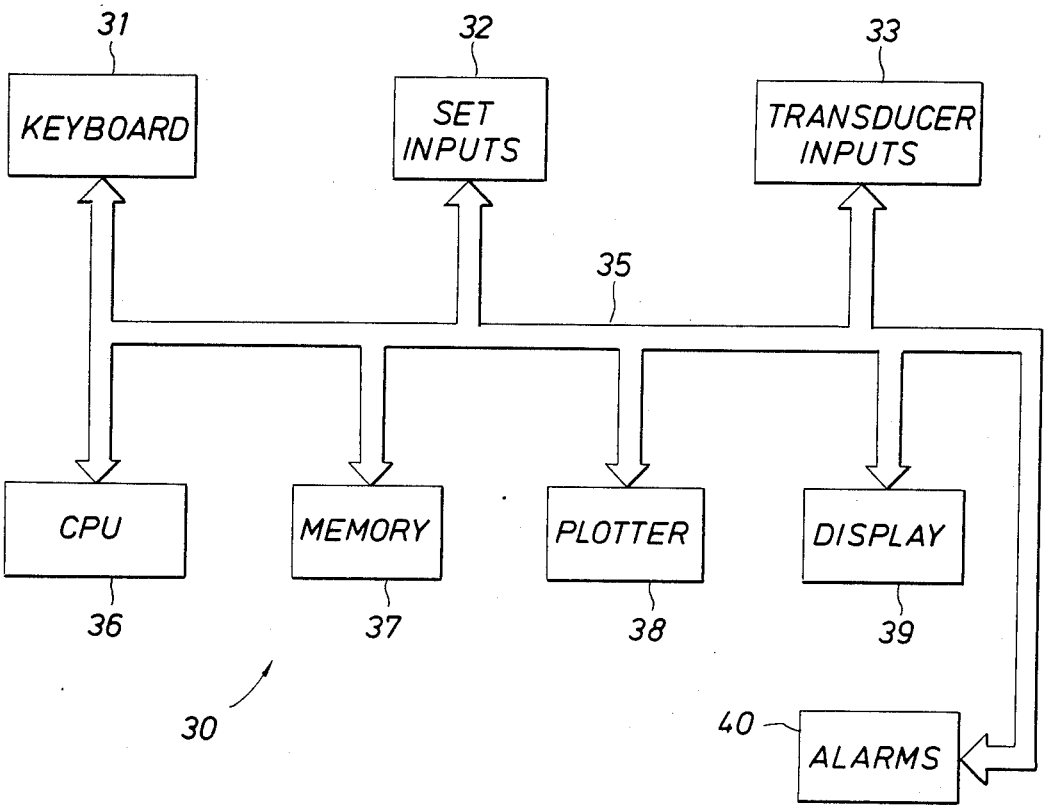
FIG. 2 is a block diagram schematic of the cementing system of this disclosure and includes various inputs and a plotter and display therefor.

The transducers shown in FIG. 1 include the flow meter 15. Additional transducers are the devices 16–18, and they are all preferably input to the system shown in FIG. 2. This system is identified generally by the numeral 30. Briefly, it incorporates a keyboard 31 for entry of various data. There is an additional set of inputs at 32 where specific parameters for the particular well can be input. The several transducers all provide inputs data, and they are collectively represented at 33 in FIG. 2 of the drawings. These three types of inputs are all connected to a common bus 35. The bus 35 is the system bus for the apparatus represented in the schematic block form in FIG. 2 of the drawings. The bus is connected with a CPU 36. In addition, the bus 35 connects with a suitable memory 37. Multiple forms of memory can be used including tape drive mechanisms. If desired, hard disk memory can be used. Parameters for the well undergoing cementing can be input and stored conveniently in RAM memory. The bus 35 is additionally connected to a plotter 38 which forms a time dependent plot of the variables of interest. The bus is additionally connected with suitable graphic displays 39, these being discussed below. The preferred form of graphic displays includes a CRT providing in color the graphics which are discussed with regard to FIGS. 3 and 4. Alternatively, the configuration of the pump and wellhead equipment along with the down hole pipe and annulus can be graphically represented so that FIG. 1 becomes a graphic representation at the display 39. This type of display is readily usable to locate various data points on the display and to enable the operator to obtain the requisite data and to associate the data with the various parts of the well including the wellhead connected apparatus. As appropriate, suitable alarms are connected with the bus, the alarms being indicated at 40.

Figure 3:
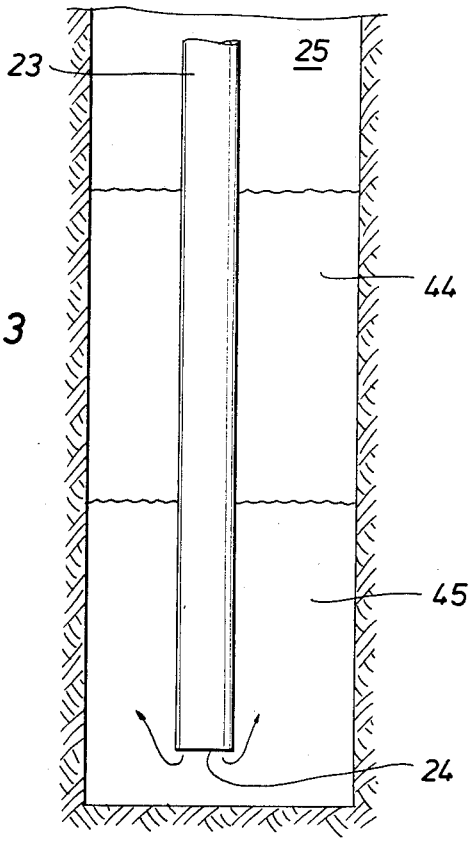
FIGS. 3 and 4 comparatively show the graphics of the display of the present disclosure wherein the display depicts a pipe in an annular space and shows different slugs of cementing fluids which are represented in FIGS. 3 and 4.
Figure 4:
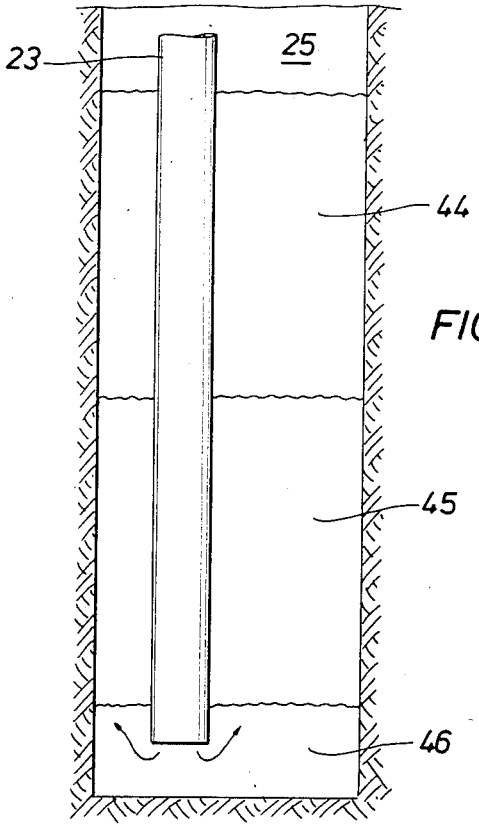

Attention is momentarily directed to FIGS. 3 and 4 jointly. There, the annular space 25 is graphically represented, and this space is filled by fluids which are delivered serially. A first fluid is pumped out the opening 24 at the bottom end of the pipe; this first fluid forms a fluid slug 44. The slug 44 has a measured volume and hence stands to a certain height in the annular space. Assuming that it routinely flows as a fluid, it is located above a subsequent fluid slug. That is, the slug 44 is above the slug 45. FIGS. 3 and 4 provide some visualization of the flow sequence. Assume that three fluids are pumped into the annular space 25. In FIG. 4 the slug 44 has been moved upwardly. The slug 45 has moved upwardly; it is supported by a third slug 46 which has introduced therebelow, flowing into the annular space 25. The three slugs thus stand one on the other. While there may be some interface between them, they ordinarily flow with a relatively sharp separation.

The slugs are thus introduced into the annular space. One of the slugs may be cement while the others do not gel and can be removed thereafter. The cement slug may be isolated by adjacent slugs which aid and assist in positioning the cement slug at the desired location in the bore hole. This desired location may be delineated by suitable packers and bridge plugs. Whatever the case, FIGS. 3 and 4 show in graphic form how the sequence of slugs is delivered into the bore hole and how they stand one on the other. The slugs delivered to the bore hole are represented in graphic form by the present apparatus. That is, a visual or graphic display very much akin to FIGS. 3 and 4 is provided. In other words, the graphic display sets forth in very simplistic form the pipe string 23 and the confines of the bore hole defining the space 25. Each liquid slug that is delivered is represented graphically in the display, the liquids 44, 45 and 46 being signalled by differences in color or other suitable graphic representation. Preferably, this is accomplished in real time so that the slug 44 is introduced and grows in the annular space 25. When it is full volume, it is forced upwardly by the slug 45 which is introduced below it, and this also is graphically represented, either by a different color or other delineation. The three slugs are thus graphically represented and move in real time. Through the implementation of suitable scale factors, the slugs 44, 45 and 46 can be illustrated to appropriate scale. The scale can be varied over any suitable range such as one inch of screen per hundred feet or perhaps one inch per thousand feet of well bore hole. These are scale factors, and the scale can be varied in accordance with the present disclosure.

In summary, FIGS. 3 and 4 are graphic representations best obtained from the display of the present apparatus which enables one to visualize both the string and the annular space 25. The fluid slugs are shown serially flowing from the pipe 23 into the annular space; the slugs are represented graphically and dynamically in real time, typically by differences in color.

Going now to the surface measurements, certain inferred measurements will be described. It must be kept in view that surface measurements are easily obtained and bottom hole values are very difficult to obtain. Bottom hole pressure is dependant on surface pressure plus the sum of the hydrostatic pressures for each particular fluid (one or more) in the drill string (a function of height of the drill string) and is reduced by the frictional drag of fluid flow (one or more fluids) in each pipe section including sections 21, 22 and 23. The surface pressure can be measured; the hydrostatic pressure is dependent on the density of the fluids in the tubing string, and the frictional drag is also readily calculated dependent on the parameters of the drill string and the inner wall surface frictionally dragging each particular fluid; the fluids may have different coefficients of friction. These factors can be known dependent on the nature of the tubing and the particular fluids flowing through the system. Accordingly, bottom hole pressure can be calculated with the fixed parameters resulting from the description of the tubing string, the particular fluids in the tubing string and the measured surface pressure.

Hydraulic horsepower can be obtained by multiplying surface pressure by a particular constant and flow rate. In other words, it is a function of a constant and two variables measured at the surface. Actual hydrostatic gradients can be obtained as a function of density of the fluids, therebeing one or more fluids so that the pressure at different elevations in the tubing string can be determined.

The calculated variables are preferably displayed as a function of time. In like fashion, they can be recorded on the plotter 38. Indeed, they can be recorded synchronized with the surface measurements such as pump rate, surface pressure and the like. All this data can be easily placed in a time dependent graph to comprise a permanent record with several plots of data thereon.

From this description, it will be understood that the operator must first provide the set inputs 32. These are input and stored in memory. The transducer inputs are dynamic during operation. They are input automatically, and calculations are continuously maintained to enable the determination of bottom hole pressure, hydraulic horsepower and actual hydrostatic gradients.

Figure 5:
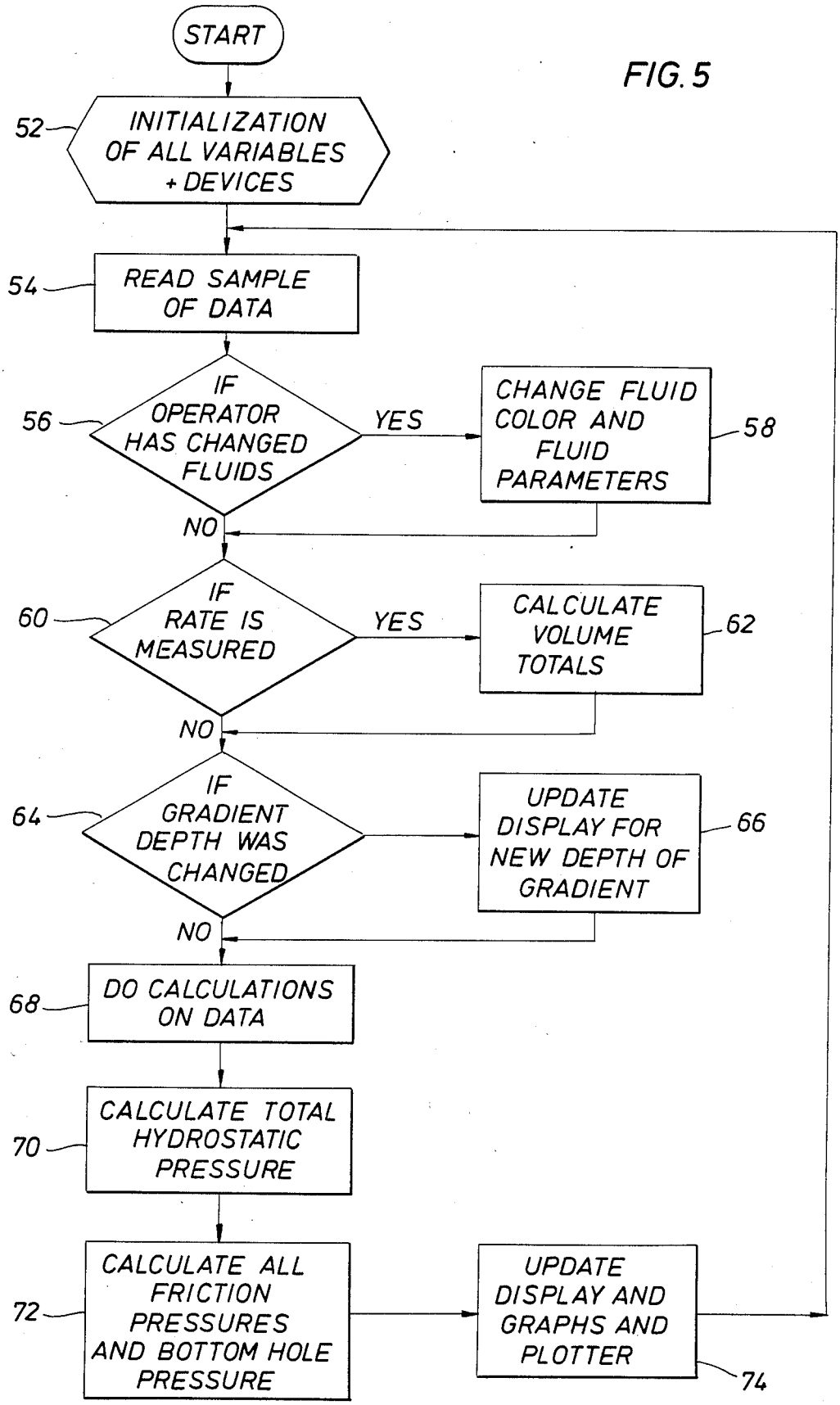
FIG. 5 is a logic flowchart illustrating the sequence of operations used to provide the real time displays.

FIG. 4 is a flowchart 50 of a program suitable for implementation with the CPU to obtain the graphics shown in FIGS. 3 and 4. The routine begins with a set of initial values for variables and set inputs. This is represented at 52 in FIG. 5 where the program advances to the next step 54 of reading sample data. Periodically, a change in pumped fluid may occur; this is represented at 56. Any fluid change involves a change in graphics color and flows with different perimeters. This step 58 loops with the step 56.

Regular flow rate measurements 60 loop with the step 62 of calculating volumetric changes. The volumetric changes progress in the pipe and are depicted in graphic form. This change of volume involves possible changes in gradient values at 64 which changes the depicted graphics at 66. Keeping in view that serial fluid slugs in the well are incremented over time, summing calculations 68 are periodically made and are used to also calculate hydrostatic pressure at 70. This step enables the step 72 of calculating bottom hole pressure. Now that all data has been updated, the displays and graphs are updated at 74. The routine is periodically repeated and the displays and graphs are again repeated and advanced to display in real time the well cementing dynamics.

As will be understood, the operation of the system is dynamic and is particularly calculated to provide displays in real time of the events which occur in the borehole. Assume for instance that the display at the CRT resembles FIGS. 3 and 4. Over a period of time, the operator will learn quite readily how to interpret such a display and will be able to more readily manipulate surface controls to obtain the desired result. Assume for instance that the operator has been told that a bridge plug is located 2,000 feet above the bottom of the well. Assume further that pumping continues until the graphics display similar to FIGS. 3 and 4 shows the column of liquid rising to 2,000 feet. As this height is approached, the operator will know for a certainty that the rising liquid will be prevented from rising further by the bridge plug. This will be inevitably accompanied by an increase in bottom hole pressure and that in turn will be accompanied by an increase in surface pressure. Therefore, when the rising column of fluid encounters the bridge plug and cannot flow past the plug, there will be a graphic forewarning to the operator based on the display to enable the operator to safely operate the system without overpressure. Thus, the operator will not be surprised when pressures start to rise indicative of the fact that the rising column of fluid in the annular space has been limited by the bridge plug.

Alternatively, the display can more nearly resemble the arrangement of FIG. 1. This also can be accommodated by showing various fluid slugs in different colors. As they are delivered, the various slugs sequentially march along the tubing string and are observed progressing down the tubing string and then upwardly through the annular space.

As will be understood from the description of the variables downhole, such variables are generally dependent on one or two surface measurements. Thus, the calculated variable can be typically represented as being of the general form $V=f(x,y)$. This type of relationship can be implemented in a relatively direct fashion and the display can be changed in real time. The dynamics of cement pumping are relatively slow to enable real time computation.

While foregoing is directed to the preferred embodiment, the scope is determined by the claims which follow.

What is claimed is:

1. A cementing system cooperative with a cement pumping apparatus including a connective manifold from the pumping apparatus to a well head for cementing the well in the completion thereof and wherein fluid pumped at the wellhead is pumped into a pipe string in the well the string having at least two sections serially joined wherein the sections have different physical characteristics of flow of fluid, the cementing system comprising:

(a) transducer means for measuring parameters of flow to the well from the pumping apparatus including means for determining wellhead pressure, said transducer means being located at the surface and obtaining surface measurements;

(b) data conversion means connected to said transducer means for determining down hole parameters including bottom hole pressure as a function of wellhead pressure from the surface measurement obtained by said transducer means;

(c) output means for providing output data indicative of down hole parameters occurring during the pumping the fluid into the well; and (d) said output means providing a visual display to an operator wherein the visual display sets forth down hole parameters.

2. The apparatus of claim 1 including CRT visual display means having a graphic representation of a well and fluid flowing therein from the pumping apparatus.

3. The apparatus of claim 2 wherein said CRT means displays a fixed graphic of a well; and wherein said CRT means displays multiple pumped fluids in visually distinguished real time graphics.

4. The apparatus of claim 3 including a graphic of a well portion including a pipe and annular space of the well.

5. The apparatus of claim 1 wherein said transducer means comprises means for measuring pumped flow rate.

6. The apparatus of claim 1 wherein said transducer means comprises means for measuring fluid density.

7. The apparatus of claim 1 wherein said transducer means comprises means for measuring wellhead pressure.

8. The apparatus of claim 1 wherein said transducer means comprises means for measuring pumped flow rate, fluid density, and wellhead pressure.

9. The apparatus of claim 1 wherein said visual display is operated in real time by said data conversion means.

10. The method of observing the flow of cementing fluids pumped into a well during well completion, the method comprising the steps of:

(a) measuring at the surface wellhead cementing fluid flow rate data;

(b) determining from the fluid data down hole fluid flow wherein the determination is dependent on the configuration of pipe in the well; and (c) displaying in graphic form the down hole fluid flow in at least a portion of a well and including at least two fluid slugs moving in a well for an operator wherein said step of displaying varies in real time.

11. The method of claim 10 including the step of measuring wellhead pressure and determining bottom hole pressure as a function of wellhead pressure and pipe configuration.

12. The method of claim 10 including the step of measuring density of fluids pumped into the well, and determining actual hydrostatic gradients along the well to the bottom.

13. The method of claim 12 including the step of determining such gradients as a function of serially pumped fluids of different densities.

14. The method of claim 10 including the step of measuring surface pressure and fluid pumping rate, and determining hydraulic horsepower as a function of such measurements.

* * * * *